US011845261B2

(12) United States Patent
Rosato et al.

(10) Patent No.: US 11,845,261 B2
(45) Date of Patent: Dec. 19, 2023

(54) BAG PULLER RELEASE POST PRINTING PROCESS

(71) Applicant: Scribe OpCo, Inc., Clearwater, FL (US)

(72) Inventors: Steve Rosato, Palm Harbor, FL (US); Andrew Chollett, Ellsworth, FL (US); Tim Sull, Wellington, OH (US)

(73) Assignee: SCRIBE OPCO, INC., Clearwater, FL (US)

( * ) Notice: Subject to any disclaimer, the term of this patent is extended or adjusted under 35 U.S.C. 154(b) by 0 days.

(21) Appl. No.: 18/326,528

(22) Filed: May 31, 2023

(65) Prior Publication Data

US 2023/0339225 A1 Oct. 26, 2023

Related U.S. Application Data

(62) Division of application No. 17/660,745, filed on Apr. 26, 2022, now Pat. No. 11,787,168, which is a division of application No. 17/450,004, filed on Oct. 5, 2021, now Pat. No. 11,345,141.

(51) Int. Cl.
*B41F 15/08* (2006.01)
*B41F 15/18* (2006.01)

(52) U.S. Cl.
CPC ..... *B41F 15/18* (2013.01); *B41F 15/0863* (2013.01)

(58) Field of Classification Search
CPC ..... B41F 15/00; B41F 15/14; B41F 15/18; B41F 15/0863; B41F 17/38; B41J 3/4078
See application file for complete search history.

(56) References Cited

U.S. PATENT DOCUMENTS

| | | | | |
|---|---|---|---|---|
| 5,653,166 | A | 8/1997 | Mohammed et al. | |
| 6,101,938 | A | 8/2000 | Adams | |
| 10,625,498 | B2 | 4/2020 | Martinez et al. | |
| 11,345,141 | B1 * | 5/2022 | Rosato | B41F 15/18 |
| 2004/0179081 | A1 | 9/2004 | Nimi et al. | |
| 2007/0240589 | A1 | 10/2007 | Eppinger | |
| 2013/0336702 | A1 | 12/2013 | Yanagishita | |
| 2016/0207301 | A1 | 7/2016 | Szyszko | |

FOREIGN PATENT DOCUMENTS

JP 2004291430 A 10/2004

* cited by examiner

*Primary Examiner* — Christopher E Mahoney
*Assistant Examiner* — Marissa Ferguson-Samreth
(74) *Attorney, Agent, or Firm* — Shumaker, Loop & Kendrick, LLP; James D. Miller

(57) ABSTRACT

A releasing system for a printing machine includes a pallet configured to support a substrate for receiving indicia printed thereon. A layer is disposed intermediate the pallet and the substrate. A releasing station selectively stretches the layer to release a surface of the substrate from a state of adhesion with the pallet.

14 Claims, 4 Drawing Sheets

BAG PULLER RELEASE POST PRINTING PROCESS

CROSS REFERENCE TO RELATED PATENT APPLICATION

This patent application is a divisional patent application of U.S. patent application Ser. No. 17/660,745 filed Apr. 26, 2022, which is a divisional patent application of U.S. patent application Ser. No. 17/450,004 filed on Oct. 5, 2021, now U.S. Pat. No. 11,345,141, the entire contents of each of which are hereby incorporated herein by reference.

FIELD

The invention relates to screen printing processes, and particularly to a device, process, and system for removal of textile articles from a rotary printing assembly.

BACKGROUND

Rotary or carousel printing machines are known for use in screen printing processes. The printing machines print on an article formed from textile, paper, plastic, or other products. These printing machines have a plurality of flat, generally rectangular platens or pallets secured to the outer ends of arms extending radially from a turntable rotatable in a path beneath an array of printing stations. Each printing station contains a printing head having a silkscreen frame holder for holding the silkscreen frame. The silkscreen frame positions and maintains a screen therein and is exposed to an image. The printing head may also have an ink dispenser that dispenses ink at one end of the silkscreen and a squeegee that is pulled across the silkscreen to evenly apply the ink.

The pallets support the articles to be printed and are advanced around the printing stations and positioned underneath the silkscreen frame holders of the printing heads, brought into contact with the silkscreens, and a pattern or image of the appropriate color is applied and "squeegeed" through the silkscreen onto the article. Typically, there are two or more pallets than the number of printing heads so that articles to be printed may be simultaneously or otherwise placed on one and removed from another without interference from components at the printing heads. In this arrangement, each of the silkscreens in the sequence commonly prints a different image on top of the previously printed image, and this subsequent image can be of a different color and design. After the articles have rotated through all the desired print heads, the articles are removed from the pallets of the printing machine.

To maximize efficiency and minimize ergonomic concerns, the articles can be automatically removed by a removal system. However, removing certain articles, such as bags, from the pallets of the printing machine can be difficult. Often the articles, such as the bags, vary in size and in order to maintain a position of the article of the pallet, a tack adhesive may be employed. The adhesive militates against the article moving with respect to the pallet so a desired accuracy of the print on the article is achieved. The adhesive is applied between a surface of the article and the pallet. For example, the adhesive may be applied directly to the pallet. The article, such as a tote bag, is opened such that an inner surface of the tote bag engages and is adhered to the pallet. The pallet then rotates beneath the print heads for the bag to receive the print. Once the bag has completed a cycle through the machine, the bag is pulled from the pallet by a puller and placed on another assembly such as a conveyor or another process machine. However, due to the varying sizes of the bags, the varying textiles used to form the bags, and the adhesive, the bags often stick to the pallet and cannot be pulled off by the puller. In an attempt to remediate the sticking of the bags, a stronger puller capable of pulling the bags with a greater force than the prior pullers was utilized. However, the stronger puller ripped or otherwise damaged the bags.

Therefore, it is desirable to include a system and method of releasing an article from being attached to a pallet of the printing machine prior to removal from the printing machine, wherein the system and method minimizes cost of production of and damage to the articles while maximizing production efficiency.

SUMMARY

In accordance and attuned with the present disclosure a system and method of releasing an article from being attached to a pallet of the printing machine prior to removal from the printing machine, wherein the system and method minimizes cost of production and damage to the articles while maximizing production efficiency has surprisingly been discovered According to an embodiment of the instant disclosure, a releasing system for a printing machine is disclosed. The system includes a pallet configured to support a substrate for receiving indicia printed thereon. A layer is disposed intermediate the pallet and the substrate. A releasing station selectively stretches the layer to release a surface of the substrate from a state of adhesion with the pallet.

According to another embodiment of the disclosure, a printing assembly for screen printing a substrate is disclosed. The printing assembly includes a hub and a first support arm extending outwardly from the hub. The first support arm includes a print head assembly coupled thereto. The print head assembly is configured to print indicia on the substrate. A second support arm extends outwardly from the hub. The second support arm includes a stretcher moveable along the second support arm. A pallet assembly rotates about the hub beneath the first support arm and the second support arm. The pallet assembly supports the substrate. A layer is disposed on the pallet assembly. The stretcher elongates the layer to release the substrate from a state of adhesion with the pallet assembly.

According to yet another embodiment of the disclosure, a method of printing on a substrate and removing the substrate from a printing machine is disclosed. The method provides a printing machine including a pallet assembly moveable with respect to a loading station, a printing station, and an unloading station. The method includes the steps of adhering the substrate to the pallet assembly at the loading station with an adhesive and printing indicia on the substrate at the printing station. The method additionally includes the step of removing the substrate from the pallet assembly at the unloading station. The method further includes the step of releasing the substrate from a state of adhesion with the pallet assembly prior to the step of removing the substrate from the pallet assembly.

DRAWINGS

The above, as well as other objects and advantages of the invention, will become readily apparent to those skilled in the art from reading the following detailed description of an embodiment of the invention when considered in the light of the accompanying drawing which:

Figure 3:
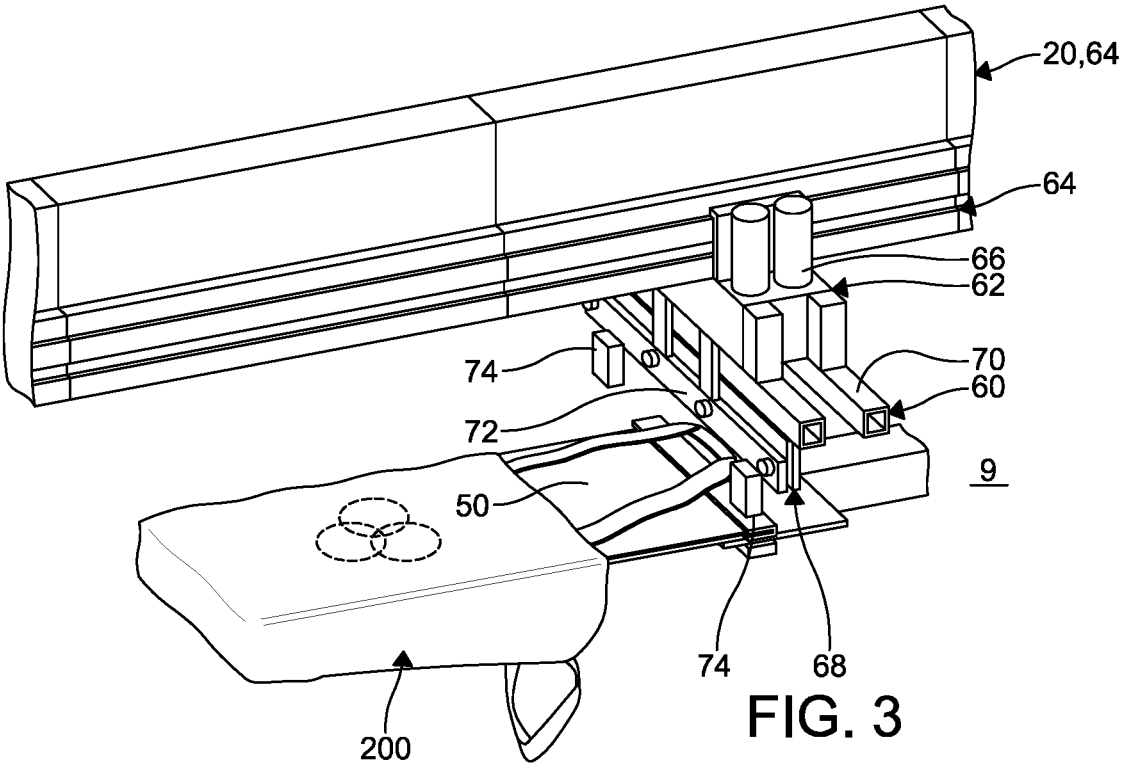
FIG. 3 is an enlarged fragmentary top perspective view of the pallet assembly, the layer, and a substrate rotated to a position beneath a stretcher of the silkscreen printing machine of FIGS. 1-2, wherein the pallet assembly is in an unraised position.
Figure 4:
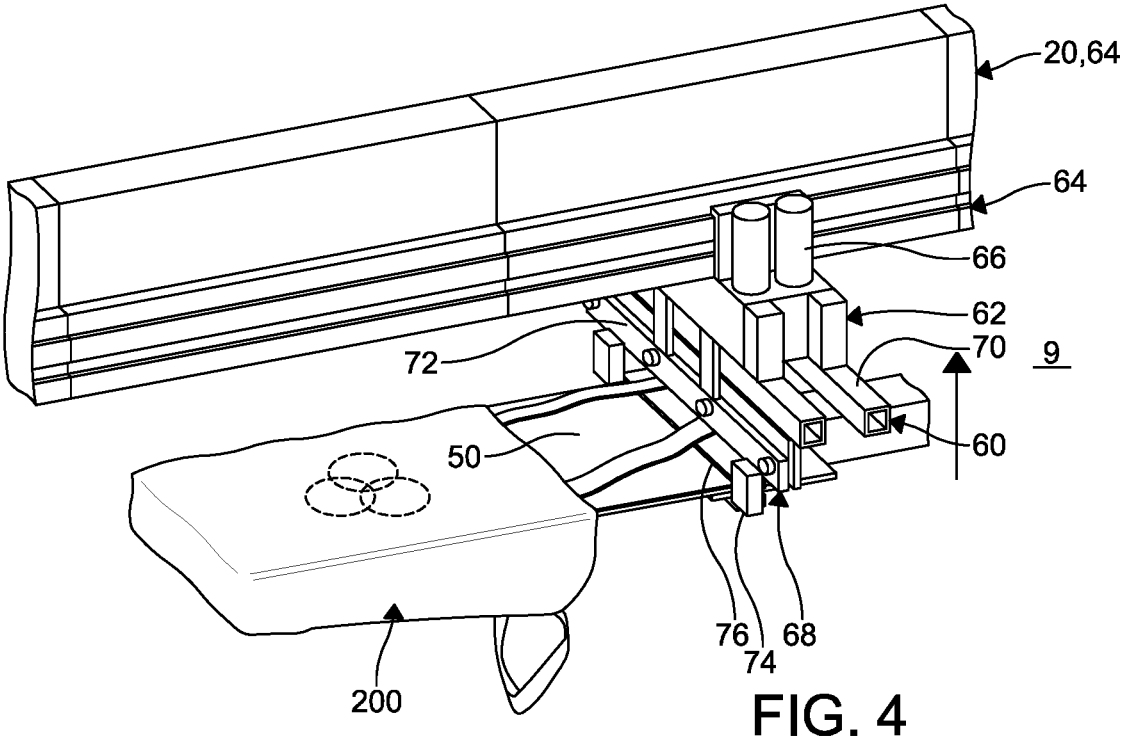
FIG. 4 is an enlarged fragmentary top perspective view of the pallet assembly, the layer, and the substrate rotated to a position beneath the stretcher of the silkscreen printing machine of FIGS. 1-3, wherein the pallet assembly is in a raised position.
Figure 5:
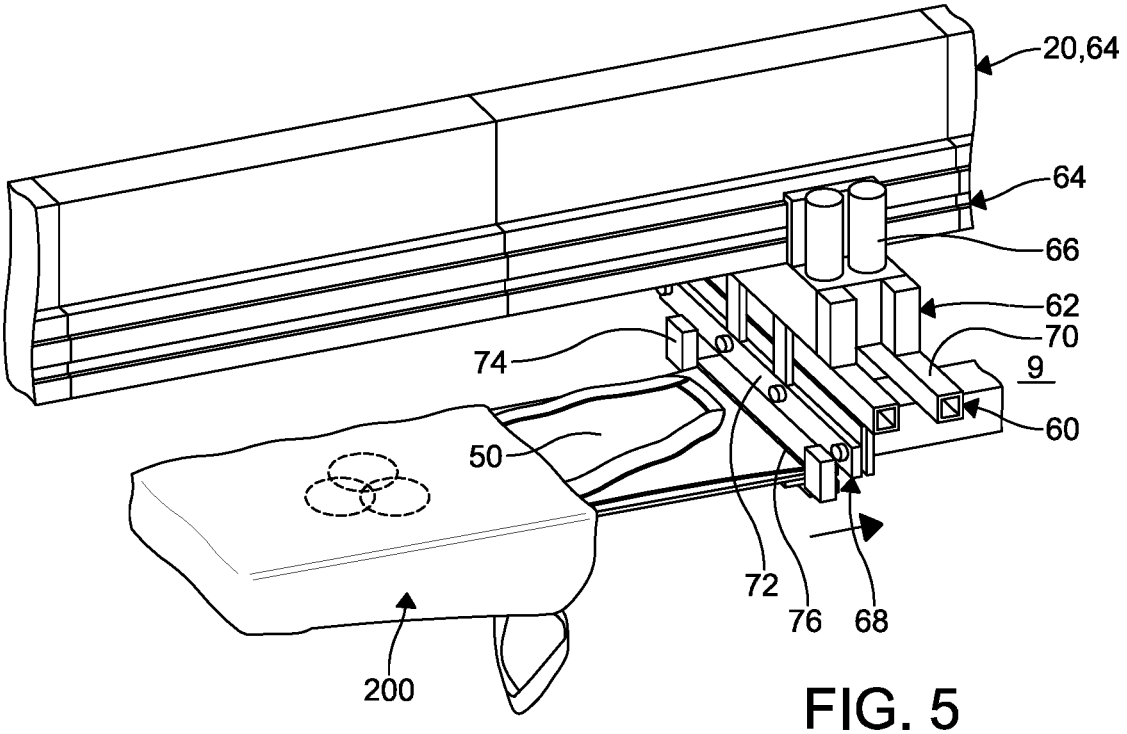
Figure 6:
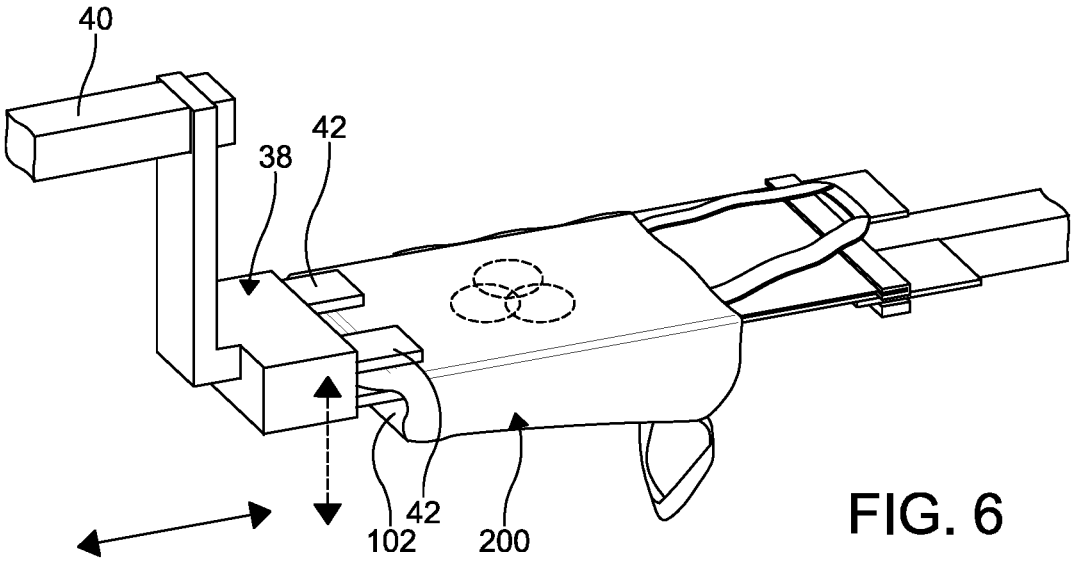

FIG. 5 is an enlarged fragmentary top perspective view of the pallet assembly, the layer, and the substrate rotated to a position beneath a stretcher of the silkscreen printing machine of FIGS. 1-4, wherein the stretcher is moving from a first position to a second position to elongate the layer; and FIG. 6 is an enlarged fragmentary top perspective view of the pallet assembly, the layer, and the substrate rotated adjacent an unloading station.

DETAILED DESCRIPTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

As used herein, substantially is defined as "to a considerable degree" or "proximate" or as otherwise understood by one ordinarily skilled in the art. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters. Where any conflict or ambiguity may exist between a document incorporated by reference and this detailed description, the present detailed description controls. Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

The disclosure relates to screen printing articles on a rotary or carousel printing machine and removing the articles therefrom. Examples of rotary screen printing machines can be found in U.S. Pat. Appl. Pub. No. 2007/0240589 and U.S. Pat. No. 6,101,938, the disclosures of which are incorporated herein by reference in their entirety. However, it is understood, the systems and methods described herein relating to release and removal of substrates from the printing machine can be employed with alternate printing machines or other rotary machines or devices.

Figure 1:
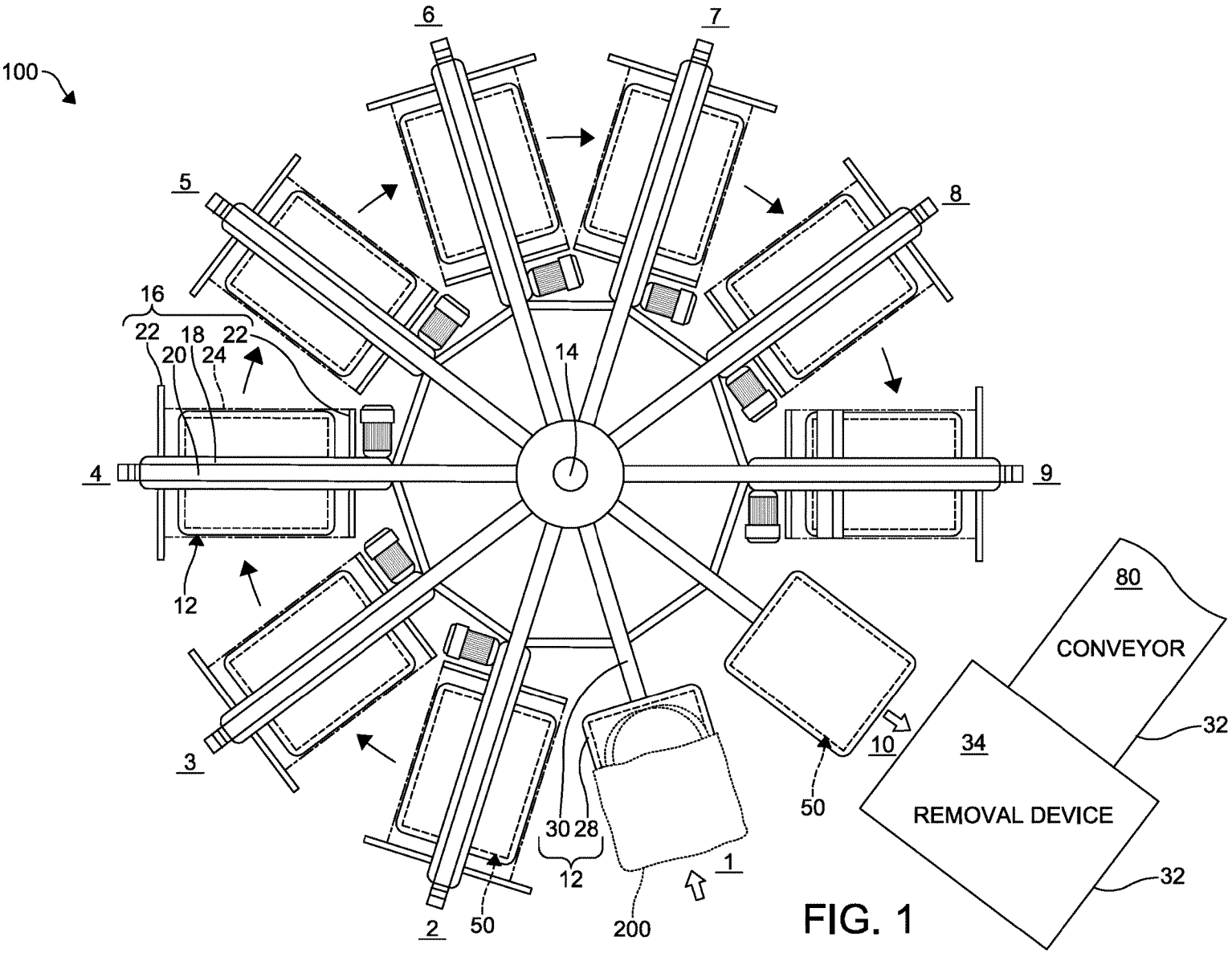
FIG. 1 is a schematic top plan view of a silkscreen printing machine according to an embodiment of the disclosure.

FIG. 1 illustrates a silkscreen printing machine 100 according to an embodiment of the disclosure. The printing machine 100 is configured as a rotary or carousel type printing machine for printing indicia on articles or substrates 200, shown in dotted lines. The printing machine 100 includes an array of pallet assemblies 12 extending radially outwardly from a central hub 14. An array of print head assemblies 16 extend radially outwardly from the hub 14 above the pallet assemblies 12. The print head assemblies 16 remain stationary while the pallet assemblies 12 rotate about the hub 14 in a direction of travel such as in a clockwise direction (as indicated by the solid arrows). Although it is understood, the pallet assemblies 12 can be stationary and the print head assemblies 16 can remain stationary without departing from the scope of the instant disclosure. Additionally, the pallet assemblies 12 can rotate in a counterclockwise direction, if desired.

The print head assemblies 16 include support arms 20, wherein a portion of the support arms 20 have print heads 18 or dispensers coupled thereto. Each of the print head assemblies 16 has a silkscreen frame 22 (shown with dotted lines) for positioning a silkscreen 24 therein (as indicated by the long and short dashed lines). The print heads 18 dispense ink or paint to the silkscreen 24. As illustrated, eight print head assemblies 16 are coupled to the hub 14. However, any number of print head assemblies 16 can be included with the printing machine 100, as desired.

As shown, ten of the pallet assemblies 12 are coupled to the hub 14. The printing machine 100 includes fewer of the print head assemblies 16 than the pallet assemblies 12 to permit simultaneous placement of the substrate 200 to and removal of the substrate 200 from the printing machine 100.

The pallet assemblies 12 each include a pallet 28 coupled to a support arm 30. In the embodiment shown, the pallets 28 have a substantially rectangular cross-sectional shape. However, the pallets 28 can have any shape as desired, depending on the product being printed. The pallets 28 support the substrate 200 and are rotated about the hub 14 via the support arms 30 and temporarily pause at consecutive positions (herein designated as positions 1-10). It is understood, more than 10 or fewer than 10 positions can be included depending on the number of print heads 18 required. As the pallets 28 rotate about the hub 14, the pallets 28 are positioned under and in line with the print heads 18 and the silkscreen frames 22 which are disposed at the positions 2-8. As used herein, the positions 2-8 including the print heads 18, silkscreen 24, and silkscreen frames 22, are herein also designated as printing stations 2-8. The position 1 corresponds to the position at which the substrate 200 is slid or positioned on the pallets 28, and will herein also be designated as the mounting station 1. As shown, the substrate 200 is illustrated at the mounting station 1, about to be rotated through the printing machine 100 on the pallets 28. The position 10 corresponds to the position at which the substrate 200 is removed from the pallets 28, and will herein also be designated as the removal station 10. A layer 50 (schematically shown with dashed lines) is disposed on the pallets 28. The layer 50 will be described in further details herein below.

As the pallets 28 rotate consecutively through the positions 1-10, the pallets 28 are then raised via the support arms 30 to engage the print head assemblies 16, wherein the indicia is transferred to the substrate 200. For example, the ink from the print head 18 is dispensed onto the silkscreen 24 and a spreader or squeegee (not shown) is employed, manually or automatically, to spread the ink across the silkscreen 24 and onto the substrate 200. The pallets 28 are all raised simultaneously in unison. However, it is understood, the pallets 28 can be raised independent of each other if desired. According to an embodiment of the disclosure, the support arms 30 are coupled to the hub 14. In one example, an end of the support arms 30 coupled to the hub 14 are linearly displaced vertically with respect to the hub 14 along a track, linear bearing, moveable plate, or similar linear translation device. In another example, the support arms 30 may pivot about an axis extending longitudinally, wherein the support arms 30 pivot up and down.

An unloading station 32 is positioned adjacent an outer circumferential path of the pallets 28 of the printing machine 100, such as adjacent the removal station 10. As shown, the unloading station 32 is positioned adjacent a portion of the printing machine 100 not including one of the print head assemblies 16 such as at the removal station 10. The unloading station 32 includes a removal device 34 (described in further detail herein below). As used herein, the removal device 34 is configured to remove the substrates 200 positioned on the pallets 28 from the pallets 28. The removal device 34 is capable of sliding the substrate 200 from the pallet 28 and positioning the substrate 200 on a conveyor, a platform, a surface, a pile of substrates, or another segment of the process 80.

The position 9 is configured for releasing the substrate 200 from the pallet 28 and will herein also be designated as the releasing station 9. The releasing station 9 is directly adjacent the unloading station 32 and prior to the unloading station 32 with respect to a direction of travel of the pallets 28. The releasing station 9 is configured to loosen, unstick, or release from a state of adhesion the substrate 200 from the pallets 28 so the substrate 200 can be easily removed from the pallet 28 at the removal station 10 with minimized force. It is understood, the removal station 10 and the releasing station 9 can be positioned at any of the positions 1-10 of the printing machine 100 as desired. Additionally, the removal station 10 and the releasing station 9 do not have to be positioned in the positions directly adjacent each other.

Figure 2:
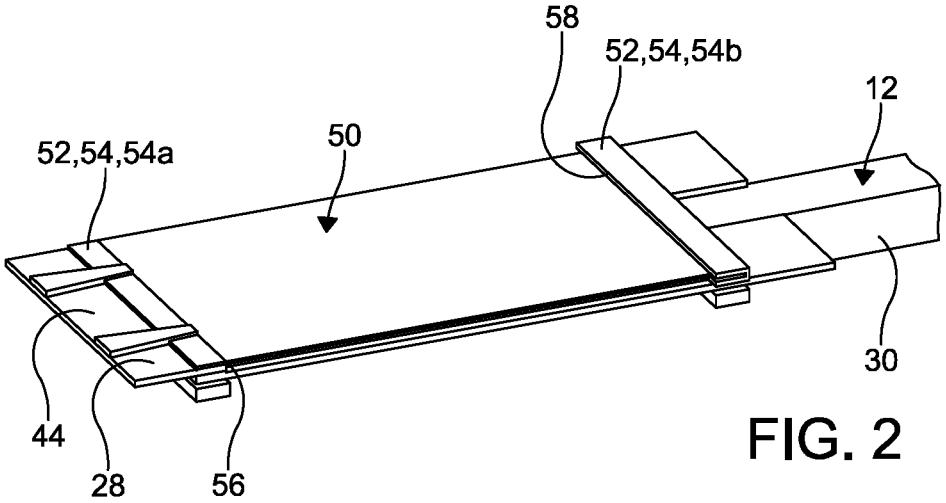
FIG. 2 is an enlarged fragmentary top perspective view of a pallet assembly and a layer coupled to the pallet assembly of the silkscreen printing machine of FIG. 1.

As shown in FIG. 2, the layer 50 is disposed intermediate an upper surface 44 of the pallets 28 and the substrate 200. For example, where the substrate 200 is a tote bag, the layer 50 is disposed intermediate the upper surface 44 of the substrate 200 and an inner surface of the substrate 200. The layer 50 is formed from a flexible or elastic material, wherein the material can be stretched and returns to its original form. For example, the layer 50 is formed from a polyurethane material such as a soft pliable and elastic polyurethane material. The polyurethane material can be PRIMOTHANE® polyurethane material owned by Midwest Rubber. According to another example, the layer 50 is a pliable and elastic silicone material. It is understood the layer 50 can be formed from other pliable and elastic material, if desired, such as an elastomer, synthetic fabrics configured to stretch, or any other material that can be stretched or otherwise manipulated and substantially returns to its original form. As illustrated, the layer 50 is a rectangular sheet of the material. Although, other shapes of the sheet can be employed without departing from the scope of the disclosure.

The layer 50 is coupled to the pallet 28 by a frame 52. The frame 52 includes a pair of clamping members 54 disposed at opposing ends of the layer 50. A first one of the members **54*a* rigidly couples a first end 56 of the layer 50 to a distal outer end of the pallet 28. A second one of the members 54*b*, slidingly couples a second end 58 of the layer 50 to the pallet 28. The frame 52 is removably mounted to the pallet 28, wherein the layer 50 can be easily coupled to the pallet 28** and removed therefrom such as by bolts, screws, pins, clamps, etc.

FIGS. 3-5 illustrate the releasing station 9. As stated herein above, the releasing station 9 can be disposed at any of the positions 1-9 prior to the removal station 10 with respect to the direction of travel of the pallet assemblies 12. The releasing station 9 includes a stretcher 60 linearly moveable along a support arm 61. In the embodiment illustrated, the support arm 61 is one of the support arms 20 of the print head assemblies 16, wherein the print head 18, the silkscreen 24, and the silkscreen frame 22 is not coupled to the support arm 20, 61. As a result, the position 9 is interchangeable between a releasing station and a printing station. It is understood any one of the printing stations 2-8 can be a releasing station if desired.

The stretcher 60 includes a carriage 62 directly coupled to a linear track 64. The carriage 62 is moveable along the track 64 by a linear actuator 66. The linear actuator 66 is configured as a pair of cylinders pneumatically activated. However, it is understood the linearly actuator 66 can be a linear bearing, a lead screw and threaded rod mechanism, a spring device, a telescoping slide, or any other mechanism configured to move the carriage 62 in a linear manner that is mechanically, pneumatically, electrically, or hydraulically activated. A positioning bar 68 is coupled to the carriage 62 via a mount 70. As illustrated, the mount 70 is a manifold or framework depending from the carriage 62. It is understood, the positioning bar 68 can be directly coupled to the carriage 62 without departing from the scope of the disclosure.

The positioning bar 68 includes an elongate member 72 and a pair of tabs 74 each laterally disposed on the positioning bar 68. The tabs 74 depend from the member 72 towards the pallet assemblies 12. The positioning bar 68, due to the linear actuator 66 moves linearly from a first position to a second position in a direction of travel indicated by solid arrows in FIG. 5.

FIG. 3 illustrates the pallet 28 and the substrate 200 rotated beneath the support arm 61 supporting the stretcher 60. At the position shown, the pallet assemblies 12 have not yet been raised. The layer 50 is in a pre-stretched form.

FIG. 4 illustrates the first position of the positioning bar 68, wherein the pallet assemblies 12 are raised towards the support arm 61 supporting the stretcher 60 (as shown by the solid arrow in FIG. 4). In the first position of the positioning bar 68, the bar 68 is aligned with the second end 58 of the layer 50 when the layer 50 is in a pre-stretched form. More precisely, the tabs 74 of the bar 68 align with an inner surface 76 of the clamping members **54*b*. As the pallet assemblies 12 are raised, the tabs 74 are directly adjacent the inner surface 76 clamping members 54 at the second end 58 of the layer 50**.

FIG. 5 illustrates the second position of the positioning bar 68. As the bar 68 moves from the first position to the second position in the direction of travel, a linear force is translated from the tabs 74 to the clamping members 54*b*, causing the clamping members 54*b* to move in a linear direction as the clamping member 54*a* remains rigidly coupled to the pallets 28. As a result, the layer 50 is stretched or elongated. When the bar 68 moves from the second position to the first position, the layer 50 is returned to its pre-stretched form such as shown in FIG. 4. According to the instant disclosure, the pallet assemblies 12 are raised towards the supports arms 20, 30, 61. However, the support arms 20, 30, 61 can be lowered towards the pallet assemblies 12 or the pallet assemblies 12 and support arms 20, 30, 61 can move simultaneously towards each other.

FIG. 6 illustrates the removal device 34 according to an embodiment of the instant disclosure. The removal device 34 includes a trolley 38 moveable along and depending from a linear track 40. The trolley 38 travels in a direction (indicated by the solid double-ended arrow) between a grip position adjacent the pallet assemblies 12 and a drop position spaced in a radial outward direction from the pallet assemblies 12 with respect to the hub 14. The track 40 substantially aligns with the support arm 30 of the pallet assemblies 12 when the pallet assemblies 12 are rotated to the removal station 10. The trolley 38 includes a pair of grippers 42 configured for clasping an outer end 102, with respect a radial direction of the support arms 30 of the pallet assemblies 12, of the substrate 200. For example, where the substrate 200 is a tote bag, the pallet 28 is received through the opening of the tote bag, at the mounting station 1, so the bottom of the tote bag is positioned at a distal outer end of the pallet 28. To remove the tote bag at the removal station 10, the grippers 42 grasp the tote bag adjacent the bottom of the tote bag. The grippers 42 are configured as a pair of clamps operating in a direction (as shown by the dashed double-ended arrow) between an open position and a closed position. In the grip position, the grippers 42 clasp the substrate 200 and pull the substrate 200 from the pallet 28 as the trolley 38 travels from the grip position to the drop position. When the trolley 38 is at the drop position, the grippers 42 move to the open position and drop or otherwise release the substrate 200 to another conveyor, platform, surface, pile of substrates, or other segment of the process (indicated by reference numeral 80 in FIG. 1). It is understood other methods of gripping or removing the substrates 200 can be employed, such as hooks, fingers, other automatic or manual systems, or any other method or system of removing the substrates from the pallet assemblies 12.

With renewed reference to FIGS. 1-6, in application, the layer 50 is coupled to the pallet assemblies 12 with the frame 52. An upper surface of the layer 50 is coated with the adhesive or tack material. The substrate 200 is positioned on the pallet 28 of the pallet assemblies 12 at the mounting station 1. In the example illustrated, the substrate 200 is a tote bag and the pallet 28 is received in the opening of the tote bag. The substrate 200 is positioned relative to the pallet 28 depending on the type of the substrate 200 or position on the substrate 200 where the indicia will be received. The adhesive removeably adheres the substrate 200 to the layer 50. The adhesive facilitates in militating against movement of the substrate 200 with respect to the pallet 28 as the substrate 200 rotates and raises with the pallet assemblies 12 in the printing machine 100. The pallets 28 consecutively rotate in the direction of travel and stop at each of the printing stations 2-8 set up to print on the substrate 200. When the pallets 28 stop at each of the printing stations 2-8, the support arms 20 are raised to engage the silkscreen. The print head 18 dispenses ink and the squeegee spreads the ink across the silkscreen 24 so the ink penetrates through the silkscreen 24 to the substrate 200. It is understood, depending on the amount of differing ink required, the substrate 200 may not receive ink from each of the printing stations 2-8.

Once the pallets 28 travel through the printing stations 2-8, the pallets 28 stop at the releasing station 9. The support arms 20 are raised so the tabs 74 engage the frame at the second end 58 of the layer 50. As the bar 68 moves from the first position to the second position, the layer 50 is stretched, elongated, or lengthened via the tabs 74 engaging the inner surface 76 of the frame 52. The frame 52 at the second end 58 of the layer 50 moves linearly and the frame 52 at the first end 56 of the layer remains stationary. As the layer 50 is stretched or lengthened, a shear strength of the adhesive is overcome by the stretching resulting in the substrate 200 being loosened or non-adhered to the layer 50. As a result, the substrate 200 can be easily removed from the pallet assemblies 12 at the unloading station 32.

After being stretched, the bar 68 moves from the second position to the first position to return the layer 50 to its original form. The support arm 61 is then lowered and the pallet assemblies 12 rotate to the removal station 10. The trolley 38 of the removal device 34 moves from the drop position to the grip position, wherein at the grip position the grippers 42 engage and clamp the outer end 102 of the substrate 200. The trolley 38 then moves from the grip position to the drop position and pulls the substrate 200 from the pallet assemblies 12 to be unloaded onto the conveyor 80.

Advantageously, the releasing station 9 uniformly loosens substrates of various sizes and materials so the substrates 200 can be easily unloaded at the unloading station 32 without damage caused to the substrate 200 or the printing machine 100. As a result, of the releasing station 9 precision of printing is maintained due to the adhesive and the pallets 28 still being employed. The releasing station 9 permits interchangeability of the stretcher 60 and the print heads 18. Additionally, the releasing station 36 is disposed within the direction of travel of the pallets 28 and is timed to operate within the timing parameters of the printing machine 100 completing a full rotation. Operation down time is minimized for change overs, loading, and unloading.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A method of printing on a substrate and removing the substrate from a printing machine:

providing a printing machine including a pallet assembly moveable with respect to a loading station, a printing station, and an unloading station;

adhering the substrate to the pallet assembly at the loading station with an adhesive;

printing indicia on the substrate at the printing station;

removing the substrate from the pallet assembly at the unloading station; and releasing the substrate from a state of adhesion with the pallet assembly prior to the step of removing the substrate from the pallet assembly.

2. The method of claim 1, wherein the step of releasing the substrate from a state of adhesion with the pallet assembly includes the steps of:

positioning a layer intermediate the pallet assembly and the substrate; and elongating the layer with a stretcher.

3. The method of claim 2, wherein the stretcher includes a positioning bar and a pair of tabs extending from the positioning bar, the positioning bar linearly moveable along a track.

4. The method of claim 2, wherein the printing machine further comprises:

a hub;

a first support arm extending outwardly from the hub, the first support arm including a print head assembly coupled thereto, the print head assembly configured to print the indicia on the substrate; and a second support arm extending outwardly from the hub, the second support arm including the stretcher moveable along the second support arm, wherein the pallet assembly rotates about the hub beneath the first support arm and the second support arm.

5. The method of claim 4, wherein the first support arm is positioned before the second support arm with respect to a direction of travel of the pallet assembly and the second support arm is positioned before the unloading station with respect to the direction of travel of the pallet assembly.

6. The method of claim 4, wherein the stretcher is moveable from a first position to a second position along a linear track on the second support arm.

7. The method of claim 6, wherein the layer is coupled to the pallet assembly by a frame, and wherein the stretcher engages a portion of the frame to elongate the layer as the stretcher moves from the first position to the second position.

8. The method of claim 7, wherein the stretcher is formed from an elongate member and a pair of tabs depending from the elongate member, and wherein the pair of tabs engages an inner portion of the frame.

9. The method of claim 2, wherein the layer is formed from a pliable material.

10. The method of claim 2, wherein the layer is a polyurethane material.

11. The method of claim 2, wherein the layer is a silicone material.

12. The method of claim 2, wherein the layer is an elastomer.

13. The method of claim 1, wherein the substrate is a bag.

14. The method of claim 1, wherein the unloading station is disposed adjacent a rotational path of the pallet assembly.

* * * * *